US011029082B2

(12) United States Patent
Lindel et al.

(10) Patent No.: US 11,029,082 B2
(45) Date of Patent: Jun. 8, 2021

(54) HOUSEHOLD APPLIANCE APPARATUS, HOUSEHOLD APPLIANCE HAVING THE HOUSEHOLD APPLIANCE APPARATUS AND METHOD FOR MOUNTING A HOUSEHOLD APPLIANCE APPARATUS

(71) Applicant: BSH HAUSGERAETE GMBH, Munich (DE)

(72) Inventors: Andreas Lindel, Heidenheim (DE); Ralf Spiller, Giengen (DE); Michael Krapp, Nattheim (DE); Markus Mayer, Koenigsbronn (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 16/245,290

(22) Filed: Jan. 11, 2019

(65) Prior Publication Data

US 2019/0226753 A1 Jul. 25, 2019

(30) Foreign Application Priority Data

Jan. 24, 2018 (DE) ..... 102018201099.4

(51) Int. Cl.
*F25D 23/00* (2006.01)
*F25D 23/10* (2006.01)

(52) U.S. Cl.
CPC ..... *F25D 23/10* (2013.01); *F25D 23/00* (2013.01); *F25D 2400/38* (2013.01)

(58) Field of Classification Search
CPC ..... F25D 2400/38; F25D 23/00; F25D 2323/0011; F25D 23/006; F25D 2400/32; F25D 2323/002; F25D 21/14; F25D 23/10; D06F 39/125; B60B 33/0002; F25B 31/006
USPC ..... 248/500, 188.1–188.5, 346.11; 312/257.1, 249.8, 351.11, 351.12, 351.7, 312/351.1, 351.2, 351.3, 351.4, 351.5
See application file for complete search history.

(56) References Cited

U.S. PATENT DOCUMENTS 3,437,346 A * 4/1969 Cobb ..... B62B 5/0083 280/43.2
3,868,079 A * 2/1975 Johnson ..... A47B 91/024 248/188.4
3,884,493 A * 5/1975 Weir ..... B60B 33/0002 280/79.11
3,948,410 A * 4/1976 Anderson ..... F25D 21/04 220/592.1

(Continued)

FOREIGN PATENT DOCUMENTS

CN 2121359 U 11/1992
CN 102019816 A 4/2011

(Continued)

*Primary Examiner* — Hiwot E Tefera
(74) *Attorney, Agent, or Firm* — Laurence A. Greenberg; Werner H. Stemer; Ralph E. Locher

(57) ABSTRACT

A household appliance apparatus, in particular a household refrigeration appliance apparatus, has at least one supporting unit for contacting with a supporting surface, and with a housing base unit which has a first base portion and at least one second base portion which define an intermediate space in at least one region. Accordingly, the supporting unit is arranged at least partially in the intermediate space and thus a reduced installation space relative to the supporting unit is needed.

18 Claims, 5 Drawing Sheets

(56) References Cited

U.S. PATENT DOCUMENTS 4,124,187 A * 11/1978 Webb ..... F16M 7/00 248/188.3
4,180,231 A * 12/1979 Burnham ..... F16F 1/3835 248/632
4,192,564 A * 3/1980 Losert ..... D06F 39/125 248/188.3
4,497,183 A * 2/1985 Gelbard ..... F25B 31/006 62/279
4,748,715 A * 6/1988 Rice ..... B60B 33/06 16/19
4,783,879 A * 11/1988 Weaver ..... B60B 33/04 16/19
4,932,729 A * 6/1990 Thompson ..... A47B 91/002 16/19
4,955,569 A * 9/1990 Hottmann ..... F16M 7/00 248/188.2
4,991,805 A * 2/1991 Solak ..... F16M 7/00 248/188.4
5,580,137 A * 12/1996 Doan ..... B25H 1/04 312/249.8
5,749,550 A * 5/1998 Jackson ..... A47B 91/022 248/188.2
5,971,408 A * 10/1999 Mandel ..... B60B 33/06 248/188.4
8,240,685 B2 * 8/2012 Fan ..... B60B 33/0002 280/79.11
8,857,774 B2 * 10/2014 Aoyama ..... B60B 33/0002 108/177
8,881,545 B2 11/2014 Lee et al.
2006/0237929 A1 * 10/2006 Taguchi ..... B62B 3/00 280/47.34
2009/0218471 A1 * 9/2009 Kempte ..... A47B 77/02 248/500
2016/0201973 A1 * 7/2016 Lokhande ..... F25B 31/00 62/296
2017/0051965 A1 * 2/2017 Lokhande ..... F25D 23/006
2017/0130390 A1 * 5/2017 Park ..... F25D 21/14
2017/0241697 A1 * 8/2017 Lokhande ..... F25D 21/14
2018/0156380 A1 * 6/2018 Lindel ..... F25D 25/025

FOREIGN PATENT DOCUMENTS

CN 102405382 A 4/2012
CN 102753919 A 10/2012
CN 102405384 A 8/2015
CN 107076498 A 8/2017

* cited by examiner

HOUSEHOLD APPLIANCE APPARATUS, HOUSEHOLD APPLIANCE HAVING THE HOUSEHOLD APPLIANCE APPARATUS AND METHOD FOR MOUNTING A HOUSEHOLD APPLIANCE APPARATUS

CROSS-REFERENCE TO RELATED APPLICATION

This application claims the priority, under 35 U.S.C. § 119, of German application DE 10 2018 201 099.4, filed Jan. 24, 2018; the prior application is herewith incorporated by reference in its entirety.

BACKGROUND OF THE INVENTION

Field of the Invention

The invention relates to a household appliance apparatus.

A household appliance apparatus with a supporting unit having a supporting roller for contact with a supporting surface is known from the prior art. The supporting unit is mounted on a compressor support rail. Additionally, household appliances with household appliance apparatuses which have a roller unit are known, wherein in order to alter the position of the household appliance the household appliance has to be tilted.

SUMMARY OF THE INVENTION

The object of the invention, in particular, is to provide a generic household appliance apparatus with improved properties with regard to the use of the installation space. The object is achieved according to the invention by the features of the independent claim, while advantageous embodiments and developments of the invention may be derived from the subclaims.

The invention is based on a household appliance apparatus, in particular a household refrigeration appliance apparatus, with at least one supporting unit for contact with a supporting surface, and with a housing base unit which has a first base portion and at least one second base portion which define an intermediate space in at least one region.

It is proposed that the supporting unit is arranged at least partially, and preferably at least to a large part, in the intermediate space.

A "household appliance apparatus" is intended to be understood, in particular, as at least one part, in particular a subassembly, of a household appliance, in particular of a household refrigeration appliance. In particular, the household appliance apparatus may also encompass the entire household appliance, in particular the entire household refrigeration appliance. Particularly advantageously, a household appliance which is configured as a household refrigeration appliance is provided to refrigerate, in the at least one operating state, refrigerated goods, in particular food, such as for example beverages, meat, fish, milk and/or dairy products, in particular in order to provide a longer shelf life of the refrigerated goods. The household appliance which is configured as a household refrigeration appliance, in particular, may be a chest freezer and advantageously a refrigerator and/or upright freezer. Alternatively, the household appliance may be configured as a cooking appliance, in particular an oven, as a dishwasher, as a laundry treatment appliance, in particular a washing machine and/or a laundry dryer, and/or as a further appliance which appears expedient to the person skilled in the art.

The first base portion and the second base portion are, in particular, part of a lower face of the household appliance. A "lower face" is intended to be understood, in particular, as a side of an outer wall and/or a housing, in particular of the household appliance, at least substantially facing a supporting surface in an installed position and in at least one operating state, a gravitational force being effective in the direction thereof. In particular, the first base portion may preferably be configured in one piece from sheet metal and have a plurality of partial regions. Preferably, the household appliance contains at least one machine space. In particular, the first base portion may define the machine space of the household appliance on a front face of the household appliance. The machine space which, in particular, contains at least one fan unit and/or a compressor unit and/or a condenser unit, is in particular defined by the second base portion on a side facing the supporting surface in at least one operating state. A "front face" is intended to be understood, in particular, as a freely accessible side of an outer wall, in particular of the household appliance, at least substantially facing an operator in an installed position and in at least one operating state, in particular not concealed by a region of a kitchen unit or a room wall or a further surface defining an alcove, wherein the side preferably has a door, in particular a refrigerator door or upright freezer door. A "rear face" is intended to be understood, in particular, as a side of an outer wall, in particular of the freestanding household appliance, at least substantially remote from the front face. The terms "top", "bottom" and "above" and "below" refer, in particular, to an installed position, in particular of the freestanding household appliance, in at least one operating state.

"Provided" is intended to be understood as specifically designed and/or equipped. An object being provided for a specific function is intended to be understood, in particular, as the object fulfilling and/or carrying out this specific function in at least one use state and/or operating state.

A "supporting unit" is intended to be understood here, in particular, as a component of a household appliance apparatus and/or a household appliance, wherein the supporting unit in at least one operating state is in contact with a supporting surface and is at least partially loaded with a weight force of the household appliance apparatus and/or the household appliance. In particular, the supporting unit is provided to support at least partially a household appliance. A "supporting surface" is intended to be understood here, in particular, as a surface, preferably a floor surface or kitchen unit bottom surface, on which the household appliance is positioned, wherein this household appliance is in contact with the surface, at least in a region of the surface, preferably by the supporting unit, due to a gravitational force acting in a gravitational field, wherein the surface is oriented at least substantially transversely to a direction of the acting gravitational force, wherein the freestanding household appliance may advantageously adopt a stable position.

A "housing base unit" is intended to be understood, in particular, as a part of a housing outer wall of a household appliance and, in particular, as a part of a lower face of the housing outer wall of the housing appliance. An "outer wall" is intended to be understood here, in particular, as a surface of a household appliance which is oriented outwardly and which encloses an interior of the household appliance at least substantially in at least one operating state.

The expression "at least to a large part" is intended to be understood in this case, in particular, as having a mass component and/or volume component of at least 55%, advantageously of at least 65%, preferably of at least 75% and particularly preferably of at least 85%.

By means of the embodiment according to the invention, in particular, an optimized and/or improved design may be achieved and, in particular, a space-saving arrangement may be achieved, in particular of the supporting unit. In particular, the complexity of a construction may be reduced, whereby the cost of production is reduced, both in terms of operation and also maintenance. Additionally, an advantageously simple mobility of a household appliance with a space-saving arrangement of the supporting unit may be obtained. In particular, for changing the position of the household appliance it is not necessary to tilt the household appliance, whereby the risk of accidents may be advantageously minimized.

Additionally, it is proposed that in an installed position the first base portion extends in a first partial region at least substantially parallel to the supporting surface and in a second partial region is oriented at an angle to the supporting surface. "Substantially parallel" is intended to be understood here, in particular, as an alignment of a direction relative to a reference direction, in particular in one plane, wherein the direction has a deviation relative to the reference direction, in particular, of less than 8°, advantageously less than 5° and particularly advantageously less than 2°. By a first and a second region extending "at an angle" to one another is intended to be understood here, in particular, that a surface normal of the first region and a surface normal of the second region enclose an angle which differs from 0°, and in particular are not parallel, wherein the respective surface normal is defined relative to a main extension plane of the respective region. A "main extension plane" of an object is intended to be understood, in particular, as a plane which is parallel to a largest side surface of a smallest imaginary geometric rectangular parallelepiped which only just fully encloses the object and, in particular, runs through the central point of the rectangular parallelepiped. The intermediate space may be advantageously defined thereby. Additionally, a space-saving construction may be implemented since, in particular, further components are able to be arranged in a space produced by an angled design. In particular, the second partial region has a first and a second lower portion. In particular, a first angle enclosed by a surface normal of the first partial region and by a surface normal of the first lower portion of the second partial region may have a value of between 30° and 60°, wherein the surface normals are arranged on an outer face or inner face of the first base portion. In particular, a second angle enclosed by a surface normal of the first partial region and by a surface normal of the second lower portion of the second partial region may have a value of between 0° and 120°, wherein the surface normals are arranged on an outer face or inner face of the first base portion. Preferably, the second angle ranges between 45° and 90°, particularly preferably the second angle is equal to 90°.

Preferably, the first and the second angle are constant over an entire width of the housing base unit. In particular, in a region in which the first partial region and the second partial region come together, the first partial region and the second partial region form an edge which runs over the entire width of the housing base unit. A "width of the housing base unit" is intended to be understood, in particular, as an extent of the housing base unit at least substantially parallel to the supporting surface, in an installed position and in at least one operating state, at least substantially along the rear face of the household appliance in a partial region of the outer wall.

It is further proposed that the intermediate space extends over an entire width of the housing base unit. As a result, a production process of the household appliance apparatus, in particular the forming of the intermediate space, may be simplified since a plurality of intermediate spaces which are provided, for example, for each supporting unit do not have to be formed in a plurality of method steps. Moreover, a variable arrangement with regard to a positioning of one or more supporting units is possible, for example, depending on the nature of the supporting surface over an entire extent of the intermediate space. Preferably, the intermediate space in its longitudinal extent is oriented at least substantially parallel to the front face of the household appliance. In particular, a plurality, preferably two, supporting units may be arranged in the intermediate space, wherein the supporting unit, in particular, may permit a movement of the household appliance in a preferred direction of movement. A "longitudinal extent" of an object is intended to be understood, in particular, as a length of a longest edge of a smallest imaginary geometric rectangular parallelepiped which only just fully encloses the object.

It is further proposed that the intermediate space, viewed along its longitudinal extent, has a triangular or quadrangular cross-section. As a result, a simple design may be produced. In particular, one or more supporting units may be mounted in a simple and rapid manner, whereby a saving in terms of time and cost may be achieved. The cross-section may, in particular, be of trapezoidal configuration. Alternatively, it is also conceivable that the cross-section may be of circular arc-shaped configuration. By an embodiment of the intermediate space which is specific to requirements, an arrangement of different sizes of supporting units in the intermediate space may be possible. Additionally, in particular, differently configured supporting unit fastenings may be used.

It is further proposed that the supporting unit is in contact with the first base portion. As a result, in particular, an advantageous mounting and a space-saving arrangement of the supporting unit may be implemented. In particular, a permanent, releasable or nonreleasable connection between the supporting unit and the first base portion may be produced thereby. The connection may be a material, non-positive and/or positive connection. By the contact of the supporting unit with the first base portion a weight of the household appliance may be supported on a non-load-critical unit of the household appliance. A region of the first base portion in which the contact is made, in particular, is dependent on a region determined by a weight distribution of the household appliance so that an optimal weight distribution is implemented on all supporting units arranged on the household appliance.

When the application recites a positive connection, also known as a form-locking connection, it is a connection that connects two elements together due to the shape of the elements themselves (e.g. ball and socket), as opposed to a force-locking connection, also known as a non-positive connection, which locks the elements together by force external to the elements (e.g. screw).

For example, the supporting unit could have at least one screw fastening portion with at least one recess for receiving a fastening screw. As a result, a safe, load-bearing and cost-effective fastening of the supporting unit may be achieved. In particular, the supporting unit is fastened to the second partial region of the first base portion by at least one screw connection. In particular, the screw fastening portion has a plate-like screw fastening lower portion and a connecting lower portion. The screw fastening lower portion may also have a further shape which is different from a plate-like embodiment. In particular, the main extension plane of the screw fastening lower portion in an installed position of the household appliance and/or in at least one operating state may be oriented at least substantially at an angle to the supporting surface. In particular, the screw fastening lower portion has the recess. The recess preferably has a recess diameter corresponding to a diameter of the fastening screw. It is also conceivable that the recess has an elongated shape in order to be able to compensate for tolerances due to inaccuracies, for example, during mounting of the supporting unit.

Moreover, it is proposed that the supporting unit has at least one positive connection fastening portion with at least one positive connection element for producing a positive connection. As a result, a cost-effective and secure connection may be produced. Additionally, the supporting unit may be mounted in a simple and time-saving manner. The positive connection fastening portion is preferably arranged on the first partial region of the first base portion. Preferably, the positive connection fastening portion is configured at least to a large part to be plate-like. The positive connection fastening portion may also have a further shape which is different from a plate-like embodiment. In particular, the positive connection element is configured as a hook element which protrudes from a main extension plane of the positive connection fastening portion. In particular, the positive connection fastening portion has two hook elements which engage through the first partial region of the first base portion.

If the screw fastening portion and the positive connection fastening portion are arranged at an angle to one another, in particular, advantages may be achieved relative to a space-saving arrangement of the supporting unit in the intermediate space. In particular, a third angle enclosed by a surface normal of the screw fastening portion, in particular the connecting lower portion, and by a surface normal of the positive connection fastening portion may have a value of between 30° and 60°, wherein the surface normals are arranged on a side facing the first base portion. In particular, a fourth angle enclosed by a surface normal of the screw fastening portion, in particular of the screw fastening lower portion, and by a surface normal of the positive connection fastening portion may have a value of between 0° and 120°, wherein the surface normals are arranged on a side facing the first base portion. Preferably, the fourth angle ranges between 45° and 90°, particularly preferably the fourth angle is equal to 90°.

An improved stability and an additional advantageous reinforcement of the first base portion may be achieved if the household appliance apparatus has at least one backing piece which is in contact with the first base portion on a side remote from the supporting surface. A longer service life and thus reduced maintenance effort and a cost reduction may be advantageously achieved thereby. By an arrangement of the backing piece on the side remote from the supporting surface, additionally a space-saving design may be achieved. In particular, the backing piece may be connected on at least one contact point by a material, positive and/or non-positive connection, preferably by means of clinching, to the first base portion. Preferably, a plurality of backing pieces is in contact with the first base portion, wherein one respective backing piece is provided for a supporting unit. The backing piece is provided to redistribute a load substantially at specific points due to the weight force of the household appliance and/or due to a shearing load and/or a torsional stress, for example when displacing the household appliance, over a larger surface and thus to reduce and/or to prevent material stress which leads to damage and/or irreversible plastic deformation of a region of the first base portion. As a result, reinforcement may be achieved at specific points in a few regions of the first base portion with a simultaneous weight reduction of the first base portion due to an advantageously low material thickness in other regions of the first base portion.

It is additionally proposed that the backing piece has at least one backing piece recess for receiving the fastening screw, wherein in a mounted state the recess of the screw fastening portion and the backing piece recess are arranged so as to be aligned with one another. In particular, the fastening screw connects the backing piece to the screw fastening portion, wherein the fastening screw engages through the first base portion which is located between the screw fastening portion and the backing piece. The backing piece recess preferably has a thread corresponding to the fastening screw. Thus, in particular, the screw fastening portion of the supporting unit may be connected fixedly to the first base portion. As a result, it is possible to mount the supporting unit in a time-saving manner. Moreover, as a result, a risk of injury to a fitter during the mounting of the supporting unit may be reduced.

In a further embodiment of the invention, it is proposed that the positive connection fastening portion has at least one screw recess and the backing piece has a fastening recess corresponding to the screw recess for receiving a fixing screw, wherein the positive connection fastening portion recess and the recess corresponding to the positive connection fastening portion recess are arranged so as to be aligned with one another. In particular, the fixing screw connects the backing piece to the positive connection fastening portion, wherein the fixing screw engages through the first base portion which is located between the positive connection fastening portion and the backing piece. The fastening recess of the backing piece preferably has a thread corresponding to the fixing screw. Thus, in particular, the positive connection fastening portion of the supporting unit may be fixedly connected to the first base portion. As a result, the supporting unit may be mounted in a time-saving manner and a greater stability of the connection may be achieved. Moreover, as a result, a risk of injury to a fitter during the mounting of the supporting unit may be reduced.

It is further proposed that the backing piece has at least one further positive connection element corresponding to the positive connection element of the supporting unit for producing a positive connection. In particular, the further positive connection element is configured as a stamped-out opening through which the positive connection element, which is preferably configured as a hook element, engages and produces a positive connection. Preferably, a backing piece has two stamped-out openings, wherein one respective stamped-out opening is provided for a hook element. During the mounting of the supporting unit the hook elements are able to be hooked into the stamped-out openings. Thus, in particular, an aligned arrangement of the backing piece recess with the recess of the screw fastening portion and an aligned arrangement of the screw recess with the fixing recess corresponding thereto is advantageously possible. As a result, in particular, a cost-effective connection may be produced. Moreover, a simple and rapid mounting of the supporting unit may be implemented thereby.

Moreover, it is proposed that the supporting unit has at least one roller. Preferably, the supporting unit has a rolling element, in particular a ball and preferably a wheel and/or particularly advantageously a roll, and in each case bearing elements required therefor. In particular, the household appliance is movable in a direction on the supporting surface which is fixed by the roller or the rolling element, so that a movement in all other directions in a supporting surface plane is able to be prevented. It is also conceivable that the supporting unit has a supporting foot. As a result, an advantageous positioning of the household appliance may be possible.

Moreover, a household appliance, in particular a household refrigeration appliance, which has at least one household appliance apparatus is proposed.

A simple and time-saving fastening of the supporting unit may be carried out, in particular, by a method for mounting a household appliance apparatus, in particular a household refrigeration appliance apparatus. The backing piece is fastened to an inner face of the first base portion and subsequently the supporting unit is connected to the backing piece on an outer face of the first base portion through said base portion.

The household appliance apparatus in this case is not intended to be limited to the above-described use and embodiment. In particular, in order to fulfill a mode of operation described herein the household appliance apparatus may have a number of individual elements, components and units which is different from that cited herein.

Other features which are considered as characteristic for the invention are set forth in the appended claims.

Although the invention is illustrated and described herein as embodied in a household appliance apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
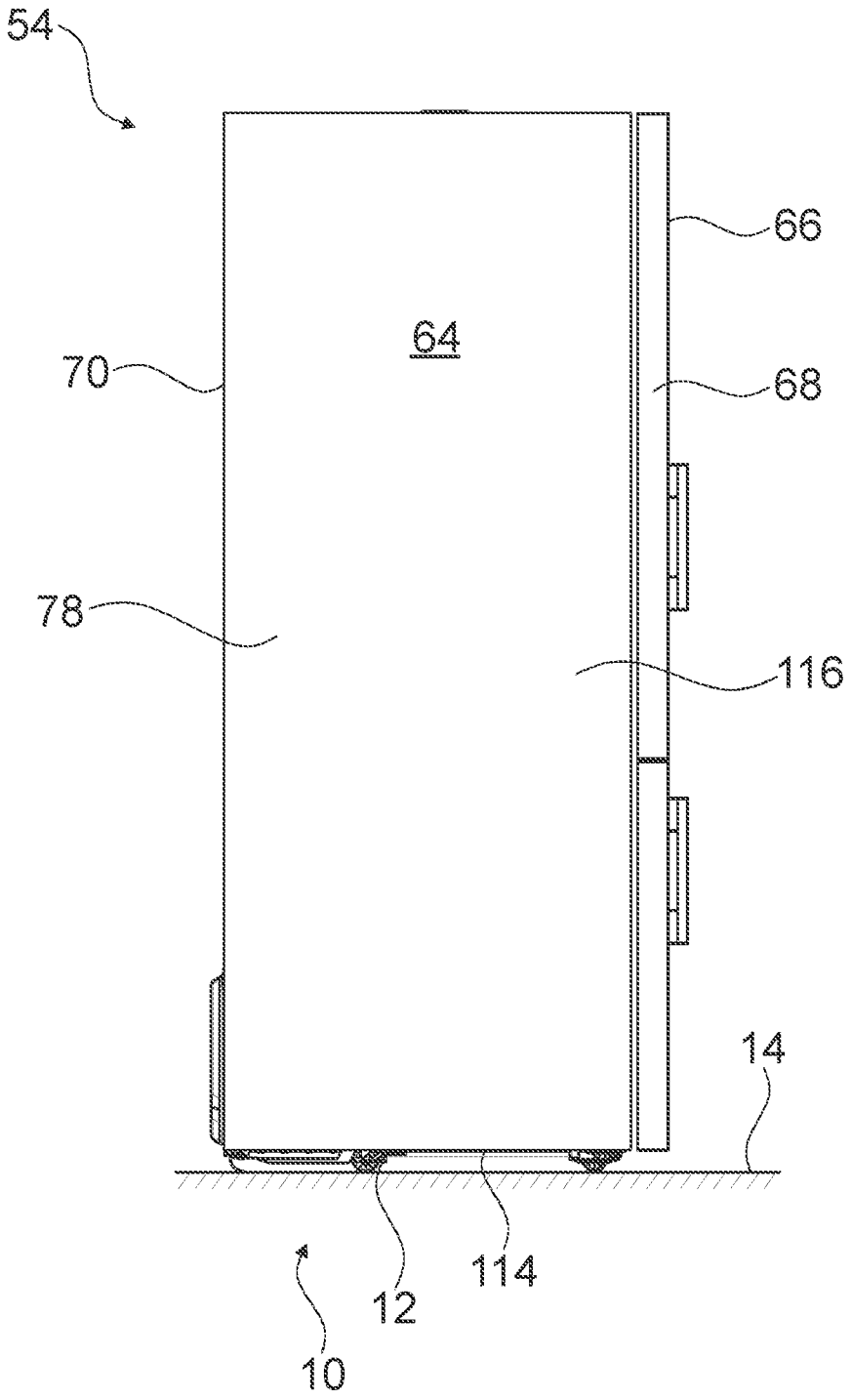
FIG. 1 is a diagrammatic, side view of a household appliance configured as a combined refrigerator/freezer with a household appliance apparatus.

Referring now to the figures of the drawings in detail and first, particularly to FIG. 1 thereof, there is shown a household appliance 54, in particular a household refrigeration appliance, in a side view. The household appliance 54 has a household appliance apparatus 10. The household appliance 54 is configured as a combined refrigerator/freezer 64. The combined refrigerator/freezer 64 has an outer wall 78. The combined refrigerator/freezer 64 has on a front face 66 a divided door 68 for a refrigerator and an upright freezer. The door 68 is, in particular, part of the outer wall 78.

Figure 2:
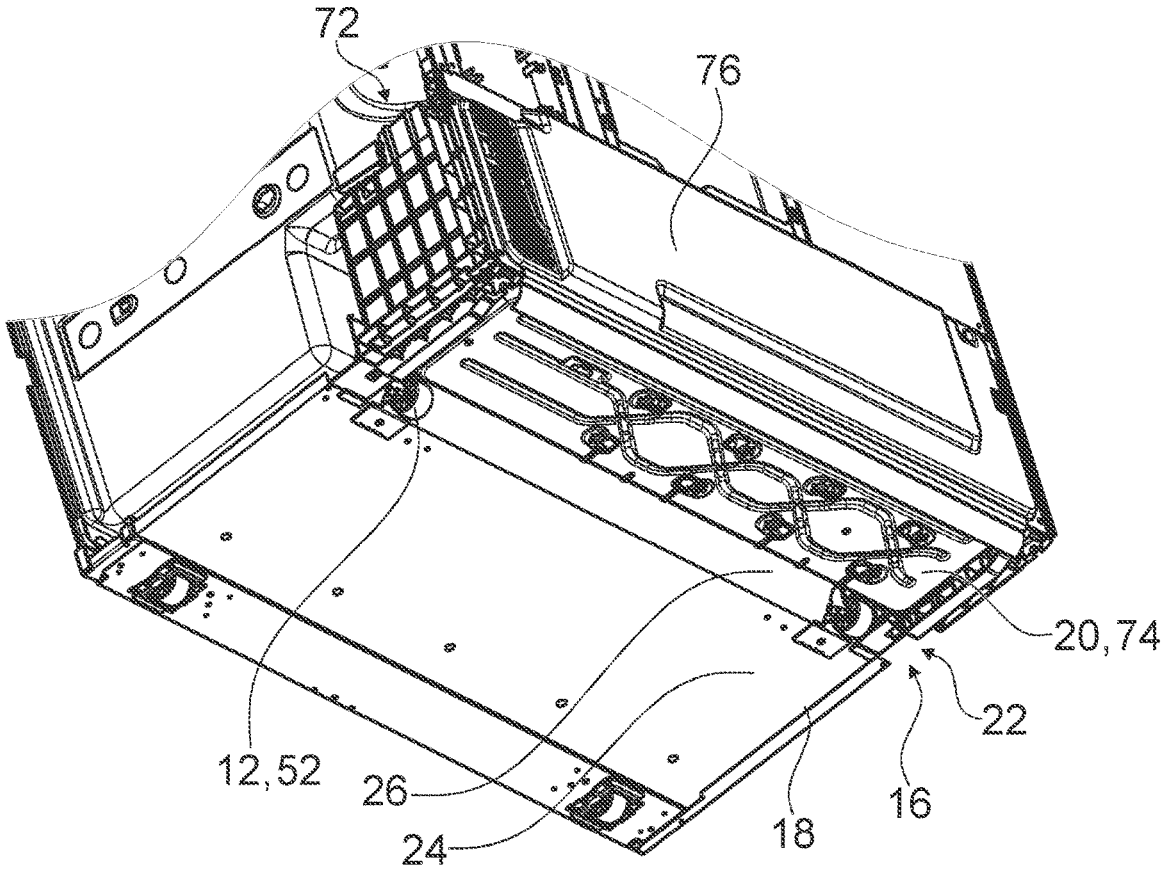
FIG. 2 is a perspective view of a lower face of the household appliance.

FIG. 2 shows a lower face 114 of the combined refrigerator/freezer 64. The combined refrigerator/freezer 64 contains a housing base unit 16. The housing base unit 16 has, in particular, a first base portion 18 and a second base portion 20. The second base portion 20 contains, in particular, a compressor support rail 74.

The compressor support rail 74 is, in particular, provided to define downwardly a machine space 72. The machine space 72 is arranged in a lower region of a rear face 70 of the combined refrigerator/freezer 64. In the machine space 72, in particular, a condenser unit, a compressor unit and a fan unit are arranged. The machine space 72 is defined to the rear by a machine space outer wall 76. The machine space 72 is at least partially defined to the front by a region of the first base portion 18. The machine space outer wall 76 is a part of the outer wall 78 of the combined refrigerator/freezer 64.

Preferably, the first base portion 18 has a first partial region 24. Preferably the first base portion 18 has a second partial region 26. The first base portion 18 extends in the first partial region 24 at least substantially parallel to a supporting surface 14. The first base portion 18 extends in the second partial region 26 at an angle to the supporting surface 14. In particular, the second partial region 26 has a first and a second lower portion 104, 106. The second lower portion 106 has a vertical path, at least substantially in its main extension plane.

In particular, a first angle 84 enclosed by a surface normal 80 of the first partial region 24 and by a surface normal 82 of the first lower portion 104 of the second partial region 26 has a value of between 30° and 60°.

In particular, a second angle 62 enclosed by a surface normal 80 of the first partial region 24 and by a surface normal 60 of the second lower portion 106 of the second partial region 26 has a value of 90°.

In particular, the first base portion 18 has a further partial region 108.

The combined refrigerator/freezer 64 has a supporting unit 12. The supporting unit 12 is provided for contact with the supporting surface 14. The supporting unit 12 has at least one roller 52. It is also conceivable that the supporting unit 12 contains a rolling element which is different from the roller 52, for example a ball, a roll or a wheel.

The first base portion 18 and the second base portion 20 define an intermediate space 22 in one region. In particular, the intermediate space 22 is configured as a recess of the housing base unit 16 oriented inwardly relative to a housing 116 of the combined refrigerator/freezer 64. The housing 116 of the combined refrigerator/freezer 64 is defined at least substantially by the outer wall 78. The intermediate space 22 extends over an entire width of the housing base unit 16. The intermediate space 22 extends in a rear half of the housing base unit 16.

Viewed along a longitudinal extent of the intermediate space 22, the intermediate space 22 has a triangular cross-section 28. In particular, the cross-section 28 has at least substantially a shape of a right-angled triangle.

Preferably, the shape and size of the cross-section 28 are at least substantially constant over the entire width of the housing base unit 16. It is also conceivable that the intermediate space 22 has a further cross-section, for example a quadrangular, in particular trapezoidal, cross-section 28.

Figure 5:
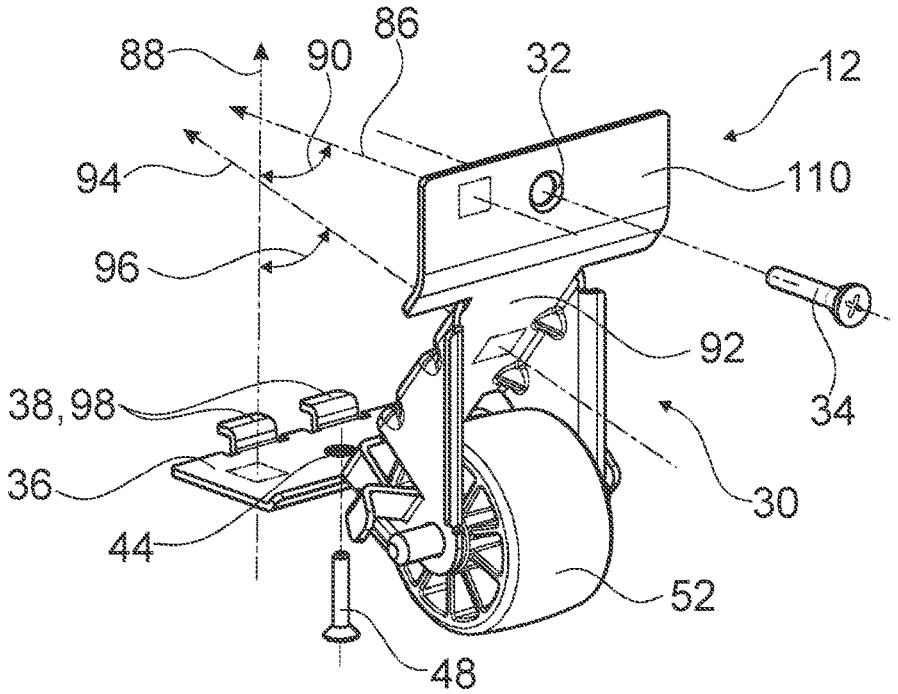
FIG. 5 is a perspective view of the supporting unit.

FIG. 5 shows a view of the supporting unit 12. In particular, the supporting unit 12 contains a screw fastening portion 30. In particular, the supporting unit 12 comprises a form-locking connection fastening portion 36.

Preferably, the screw fastening portion 30 and the form-locking connection fastening portion 36 are arranged at an angle to one another.

The screw fastening portion 30 has a screw fastening lower portion 110.

A fourth angle 90 enclosed by a surface normal 86 of the screw fastening lower portion 110 with a surface normal 88 of the positive connection fastening portion 36 is approximately 90°. The supporting unit 12 has a connecting lower portion 92. In particular, a surface normal 94 of the connecting lower portion 92 encloses a third angle 96 with the surface normal 88 of the positive connection fastening portion 36. The third angle 96 and the first angle 84 are preferably of the same size. The fourth angle 90 and the second angle 62 are preferably of the same size. It is also conceivable that the first angle 84, the second angle 62, the third angle 96 and the fourth angle 90 are of the same size.

Figure 4:
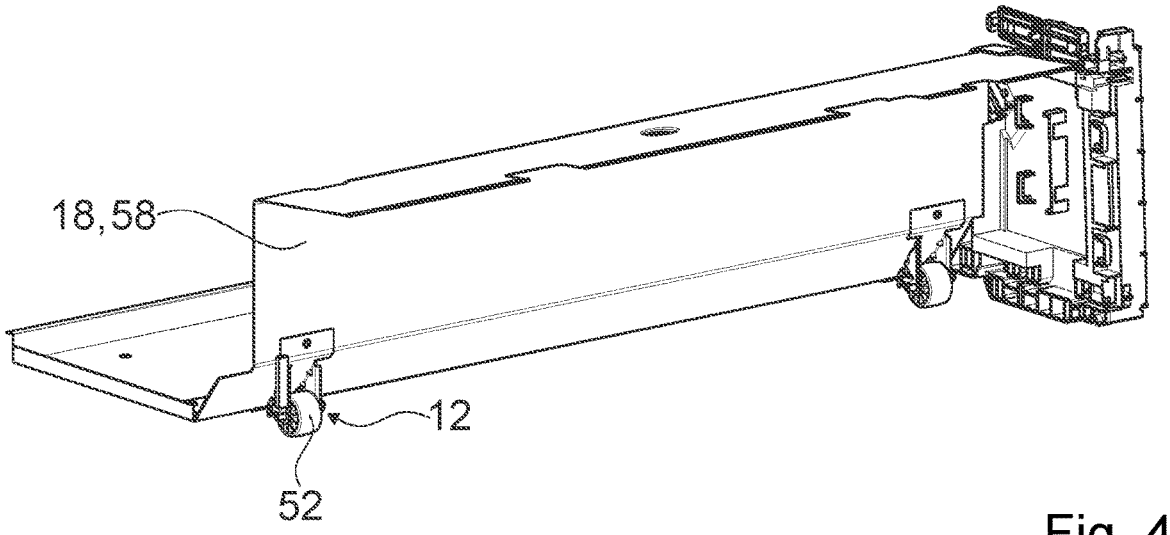
FIG. 4 is a perspective, side view of the housing base unit of the household appliance apparatus and supporting units fastened to the housing base unit, obliquely from the rear.

Two supporting units 12 are arranged at least partially in the intermediate space 22 (FIG. 2). Advantageously, the supporting units 12 are arranged at least to a large part in the intermediate space 22. In particular, the supporting units 12 are in contact with the first base portion 18, in particular on the outer face 58 thereof (see FIG. 4).

In particular, the form-locking connection fastening portion 36 is in contact with the first partial region 24. In particular, the screw fastening lower portion 110 is in contact with the first lower portion 104 of the second partial region 26.

In particular, the screw fastening lower portion 110 has a recess 32. The recess 32 is provided for receiving a fastening screw 34. The recess 32 is configured to be circular. It is also conceivable that the recess 32 has a different shape, for example an elongated shape.

In particular, the form-locking connection fastening portion 36 has at least one screw recess 44. The screw recess 44 is provided for receiving a fixing screw 48. The screw recess 44 is configured to be circular. It is also conceivable that the screw recess 44 has a different shape, for example an elongated shape.

In particular, the form-locking (also known as positive) connection fastening portion 36 has two form-locking connection elements 38. The form-locking connection elements 38 are configured as hook elements 98. The hook elements 98 are provided for producing a form-locking connection.

Figure 3:
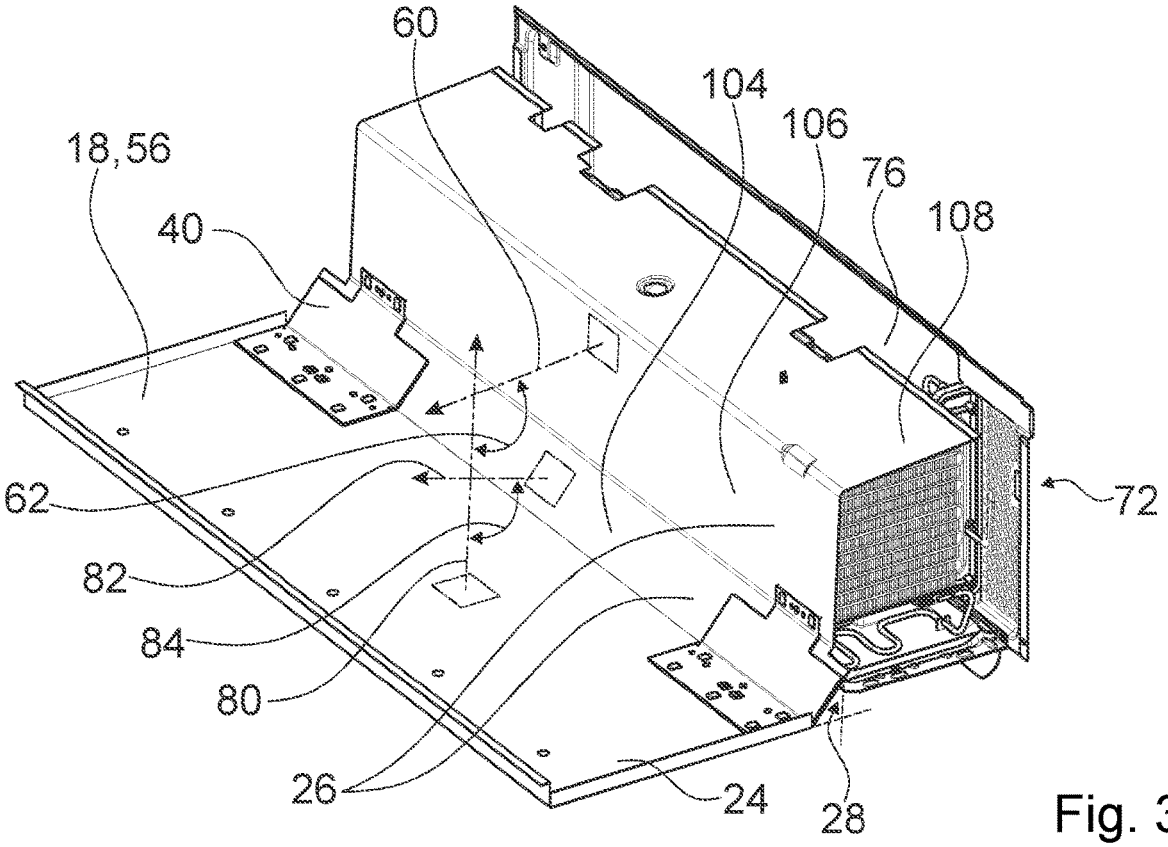
FIG. 3 is a perspective, side view of a housing base unit of the household appliance apparatus with backing pieces and a machine space.
Figure 6:
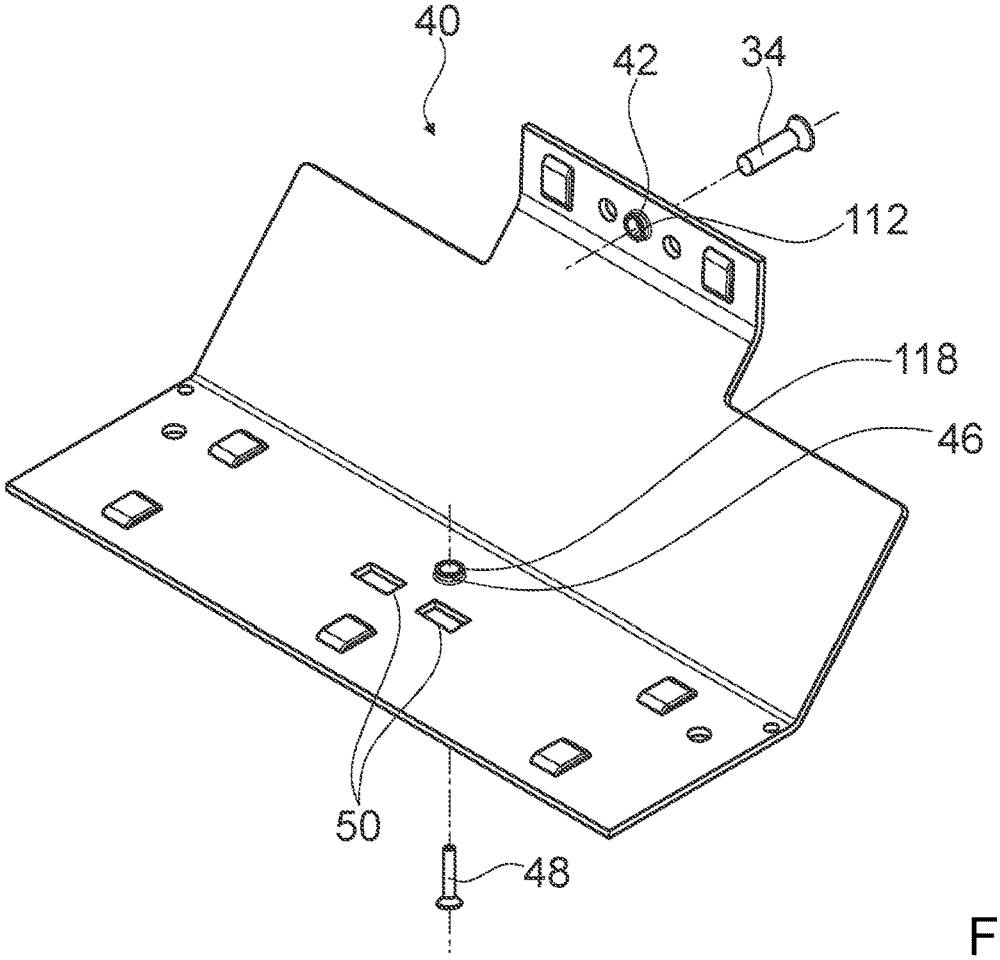
FIG. 6 is a perspective view of the backing piece.

The household appliance apparatus 10 has a backing piece 40 (see FIG. 6). The backing piece 40 is in contact, in particular, with the first base portion 18 on a side (see FIG. 3) remote from the supporting surface 14. In particular, the backing piece 40 is connected by means of a form-locking and/or force-locking connection, preferably by means of a clinched connection, to the first base portion 18.

In particular, the backing piece 40 has a backing piece recess 42. The backing piece recess 42 is provided for receiving the fastening screw 34. The backing piece recess 42 is configured to be circular. Preferably, the backing piece recess 42 has a thread 112. The recess 32 of the screw fastening lower portion 110 and the backing piece recess 42 are arranged so as to be aligned with one another in an assembled state.

In particular, the backing piece 40 has a fixing recess 46 corresponding to the screw recess 44. The fixing recess 46 is provided for receiving the fixing screw 48. Preferably, the fixing recess 46 has a thread 118. The screw recess 44 and the fixing recess 46 are arranged so as to be aligned with one another.

In particular, the backing piece 40 has two further positive connection elements 50 corresponding to the positive connection element 38 of the supporting unit 12. The further form-locking connection elements 50 are provided for producing a positive connection. In particular, the further form-locking connection elements 50 are configured as stamped-out openings.

In particular, the supporting unit 12 is connected to the backing piece 40 on the first base portion 18 by means of a form-locking and/or force-locking connection passing through the first base portion 18. The first base portion 18 is clamped between the supporting unit 12 and the backing piece 40.

Preferably, two backing pieces 40 and two supporting units 12 are arranged on the first base portion 18 in the intermediate space 22. Depending on requirements, any number of backing pieces 40 and supporting units 12 may be arranged on the first base portion 18 in the intermediate space 22, this number being different from two.

Figure 7:
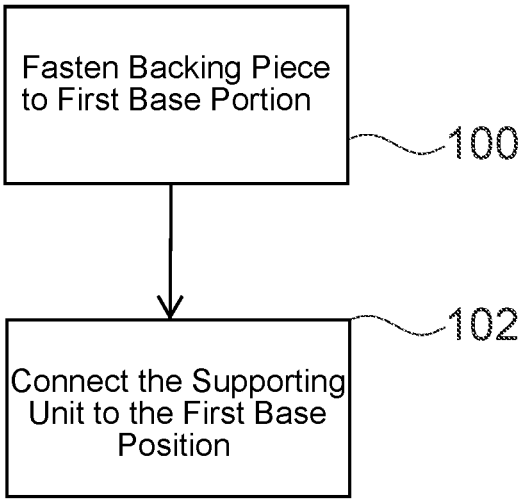
FIG. 7 is a flow chart of a method for the mounting of the household appliance apparatus.

FIG. 7 shows a sketch of a method for the mounting of the household appliance apparatus 10. The following method steps 100, 102 apply both to a backing piece 40 and a supporting unit 12 and also to a plurality of backing pieces 40 and a plurality of supporting units 12. A method for one backing piece 40 and one supporting unit 12 is described hereinafter.

In a first method step 100 the backing piece 40 is fastened to an inner face 56 of the first base portion 18, preferably by means of a clinched connection. In a further method step 102, in particular, the supporting unit 12 is connected on an outer face 58 of the first base portion 18 to the backing piece 40 by the hook elements 98, through the base portion. Subsequently, in particular, the form-locking connection fastening portion 36 may be connected on the outer face 58 of the first base portion 18 to the backing piece 40 by the fixing screw 48, through the base portion. Subsequently, in particular, the screw fastening portion 30 is connected on the outer face 58 of the first base portion 18 to the backing piece 40 by means of the fastening screw 34, through the base portion.

The following is a summary list of reference numerals and the corresponding structure used in the above description of the invention:

10 Household appliance apparatus
12 Supporting unit
14 Supporting surface
16 Housing base unit
18 First base portion
20 Second base portion
22 Intermediate space
24 First partial region
26 Second partial region
28 Cross-section
30 Screw fastening portion
32 Recess
34 Fastening screw
36 Positive connection fastening portion
38 Positive connection element
40 Backing piece
42 Backing piece recess
44 Screw recess
46 Fixing recess
48 Fixing screw
50 Further positive connection element
52 Roller
54 Household appliance
56 Inner face

58 Outer face
60 Surface normal
62 Second angle
64 Combined refrigerator/freezer
66 Front face
68 Door
70 Rear face
72 Machine space
74 Compressor support rail
76 Machine space outer wall
78 Outer wall
80 Surface normal
82 Surface normal
84 First angle
86 Surface normal
88 Surface normal
90 Fourth angle
92 Connecting lower portion
94 Surface normal
96 Third angle
98 Hook element
100 Method step
102 Method step
104 First lower portion
106 Second lower portion
108 Partial region
110 Screw fastening lower portion
112 Thread
114 Lower face
116 Housing
118 Thread

The invention claimed is:

1. A household appliance apparatus, comprising:

a housing base unit having a first base portion and at least one second base portion having a planar edge adjoining an underside of said at least one first base portion, said first base portion and said second base portion together defining a lower face of a household appliance, said lower face facing a supporting surface for supporting the apparatus, said at least one second base portion defining a compressor support rail, said first base portion and said at least one second base portion defining an intermediate space therebetween at said planar edge, said intermediate space being an inwardly directed recess extending over an entire width of said housing base unit; and at least one supporting unit for contacting with the supporting surface, the at least one supporting unit disposed at least partially in said intermediate space.

2. The household appliance apparatus according to claim 1, wherein in an installed position said first base portion extends in a first partial region at least substantially parallel to the supporting surface and in a second partial region is oriented at an angle to the supporting surface.

3. The household appliance apparatus according to claim 1, wherein said intermediate space, viewed along its longitudinal extent, has a triangular or quadrangular cross-section.

4. The household appliance apparatus according to claim 1, wherein the at least one supporting unit is in contact with said first base portion.

5. The household appliance apparatus according to claim 1, wherein the at least one supporting unit has at least one screw fastening portion with at least one recess formed therein for receiving a fastening screw.

6. The household appliance apparatus according to claim 5, wherein the at least one supporting unit has at least one form-locking connection fastening portion with at least one form-locking connection element for producing a form-locking connection.

7. The household appliance apparatus according to claim 6, wherein said screw fastening portion and said form-locking connection fastening portion are disposed at an angle to one another.

8. The household appliance apparatus according to claim 6, further comprising at least one backing piece which is in contact with said first base portion on a side remote from the supporting surface.

9. The household appliance apparatus according to claim 8, wherein said backing piece has at least one backing piece recess formed therein for receiving the fastening screw, wherein in a mounted state said recess of said screw fastening portion and said backing piece recess are disposed so as to be aligned with one another.

10. The household appliance apparatus according to claim 8, wherein:

said form-locking connection fastening portion has at least one screw recess formed therein for receiving a fixing screw; and said backing piece has a fixing recess formed therein and corresponding to said screw recess for receiving the fixing screw, and in a mounted state said screw recess and said fixing recess are disposed so as to be aligned with one another.

11. The household appliance apparatus according to claim 8, wherein said backing piece has at least one further form-locking connection element corresponding to said form-locking connection element of said supporting unit for producing a form-locking connection.

12. The household appliance apparatus according to claim 1, wherein the at least one supporting unit has at least one roller.

13. The household appliance apparatus according to claim 1, wherein the household appliance apparatus is a household refrigeration appliance apparatus.

14. The household appliance apparatus according to claim 1, further comprising a compressor mounted on said second base portion.

15. A household appliance, comprising:

the at least one household appliance apparatus according to claim 1.

16. A method for mounting a household appliance apparatus, which comprises the steps of:

providing the apparatus according to claim 1;

fastening a backing piece to an inner face of the first base portion; and subsequently connecting the at least one supporting unit to the backing piece on an outer face of the first base portion through the first base portion.

17. A household appliance apparatus, comprising:

a housing base unit having a first base portion being a sheet metal plate having an exterior side facing a supporting surface, said first base portion and a second base portion together defining a lower face of a household appliance, said lower face facing the supporting surface for supporting the apparatus, said first base portion having a first partial region defining a horizontal portion of said lower face, said first base portion having a second partial region extending upward from said first partial region, said first base portion and said at least one second base portion defining an intermediate space therebetween in at least one region at which said second base portion adjoins said second partial region, said intermediate space extending over an entire width of said housing base unit and being on said exterior side of said first base portion; and at least one supporting unit for contacting with the supporting surface, the at least one supporting unit disposed at least partially in said intermediate space, the at least one supporting unit having a form locking connection fastening portion engaging said first partial region, the at least one supporting unit having a screw fastening portion engaging said second partial region.

18. The household appliance apparatus according to claim 17, wherein said form locking connection fastening portion includes a hook for defining a form-locking connection.

* * * * *